US008025482B1

(12) United States Patent
Liang

(10) Patent No.: US 8,025,482 B1
(45) Date of Patent: Sep. 27, 2011

(54) TURBINE BLADE WITH DUAL SERPENTINE COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 682 days.

(21) Appl. No.: 12/418,575

(22) Filed: Apr. 4, 2009

(51) Int. Cl.
*F01D 5/18* (2006.01)

(52) U.S. Cl. ..... 416/97 R; 415/115; 415/116; 416/1; 416/90 R; 416/92; 416/96 R

(58) Field of Classification Search ..... 415/115, 415/116; 416/1, 90 R, 92, 96 R, 97 R
See application file for complete search history.

(56) References Cited

U.S. PATENT DOCUMENTS 5,690,473 A * 11/1997 Kercher ..... 416/97 A
6,220,817 B1 * 4/2001 Durgin et al. ..... 416/97 R
6,481,967 B2 * 11/2002 Tomita et al. ..... 416/97 R
7,547,190 B1 * 6/2009 Liang ..... 416/97 R
2002/0119045 A1 * 8/2002 Starkweather ..... 416/97 R
2002/0119047 A1 * 8/2002 Starkweather ..... 416/97 R
2008/0118366 A1 * 5/2008 Correia et al. ..... 416/97 R

* cited by examiner

*Primary Examiner* — Asok Sarkar
(74) *Attorney, Agent, or Firm* — John Ryznic

(57) ABSTRACT

A turbine rotor blade with a low cooling flow serpentine circuit to provides cooling for the airfoil. The circuit includes a three pass aft flowing serpentine circuit that begins at the airfoil mid-chord region and connects to a series of multiple impingement cooling holes formed within the trailing edge region. A double pass forward flowing serpentine circuit then connects with the triple pass aft flowing serpentine circuit to provide cooling for the leading edge region and is connected to a showerhead arrangement for discharging film cooling air. A blade tip cooling channel connects with the last leg of the double pass forward flowing serpentine to form a 6-pass serpentine flow cooling circuit for the entire blade. Since only the leading edge serpentine channel discharges film cooling air, the serpentine circuit can make use of low cooling flow to provide cooling for the entire blade.

14 Claims, 4 Drawing Sheets

View A-A

TURBINE BLADE WITH DUAL SERPENTINE COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to an air cooled blade in a gas turbine engine.

2. Description of the Related Art including information disclosed under 37 CFR 1.97 and 1.98

A gas turbine engine includes a turbine with multiple rows or stages of rotor blades that react with a high temperature gas flow to drive the engine or, in the case of an industrial gas turbine (IGT), drive an electric generator and produce electric power. It is well known that the efficiency of the engine can be increased by passing a higher temperature gas flow into the turbine. However, the turbine inlet temperature is limited to the material properties of the first stage vanes and blades and the amount of cooling that can be achieved for these airfoils.

In latter stages of the turbine, the gas flow temperature is lower and thus the airfoils do not require as much cooling flow. In future engines, especially IGT engines, the turbine inlet temperature will increase and result in the latter stage airfoils to be exposed to higher temperatures. To improve efficiency of the engine, low cooling flow airfoils are being studied that will use less cooling air while maintaining the metal temperature of the airfoils within acceptable limits. Also, as the TBC (thermal barrier coating) gets thicker, less cooling air is required to provide the same metal temperature as would be for a thicker TBC.

FIG. 1 shows an external pressure profile for a turbine rotor blade. As indicated in the figure, the forward region of the pressure side surface experiences high hot gas static pressure while the entire suction side of the airfoil is at a much lower hot gas static pressure than the pressure side. The pressure side pressure profile in the line on the top while the suction side pressure profile is the line on the bottom in the FIG. 1.

FIG. 2 shows a prior art turbine rotor blade with a (1+5+1) forward flowing serpentine cooling circuit for a first stage rotor blade. FIG. 3 shows a schematic view of the rotor blade of FIG. 2 and FIG. 4 shows a flow diagram of the flow path through the rotor blade. the prior art blade cooling circuit includes a leading edge cooling supply channel connected to a leading edge impingement cavity by a row of metering and impingement holes, and where the impingement cavity is connected to a showerhead arrangement of film cooling holes and gills holes on both sides to discharge a layer of film cooling air onto the leading edge surface of the airfoil. A forward flowing 5-pass serpentine cooling circuit is used in the airfoil mid-chord region with a first leg for supplying cooling air located adjacent to the trailing edge region of the airfoil. The second leg, third leg, fourth leg and fifth leg of the serpentine flow toward the leading edge in series with rows of film cooling holes connected to the 5 legs to discharge film cooling air onto one or bothside of the airfoil. The cooling air flows from the trailing edge region toward the leading edge region and discharges into the hot gas side pressure section of the pressure side of the airfoil. In order to satisfy the back flow margin criteria, a high cooling supply pressure is needed for this particular design, and thus inducing a high leakage flow. In the prior art cooling arrangement of FIG. 2, the blade tip section is cooled with double tip turns in the serpentine circuit and with local film cooling. Cooling air bled off from the 5-pass serpentine flow circuit will thus reduce the cooling performance for the serpentine flow circuit. Independent cooling flow circuit is used to provide cooling circuits from the 5-pass serpentine flow circuit is used for cooling of the airfoil leading and trailing edges.

As the TBC technology improves and more industrial turbine blades are applied with thicker or low conductivity TBC, the amount of cooling flow required for the blade will be reduced. As a result, there is not sufficient cooling flow for the prior art design with the 1+5+1 forward flowing serpentine cooling circuits of FIG. 2. Cooling flow for the blade leading edge and trailing edge has to be combined with the mid-chord flow circuit to form a single 5-pass flow circuit. However, for a single forward flow 5-pass circuit with total blade cooling flow BFM (back flow margin) may become a design problem.

BRIEF SUMMARY OF THE INVENTION

It is an object of the present invention to provide for a turbine blade with a thick TBC and low cooling flow for a low gas temperature condition.

The above objective and more are achieved with the cooling circuit for a rotor blade of the present invention which includes a dual flowing 6-pass serpentine flow blade cooling circuit that includes an aft flowing triple pass serpentine flow circuit in series with a forward flowing double pass serpentine circuit for the blade leading edge region. The aft flowing triple pass serpentine circuit starts around a middle of the blade mid-chord region and flows toward the trailing edge region where some of the cooling air is bled off into a multiple impingement trailing edge cooling circuit and discharged through exit holes along the trailing edge. The remaining cooling air in the serpentine circuit then flows toward the leading edge in the double pass serpentine with the last leg being a channel that flows toward the blade tip and adjacent to the leading edge cooling air supply channel. The last leg then flows along the blade tip to provide cooling to the blade tip and discharges film cooling air onto the leading edge through a showerhead arrangement of film cooling holes.

DETAILED DESCRIPTION OF THE INVENTION

Figure 5:
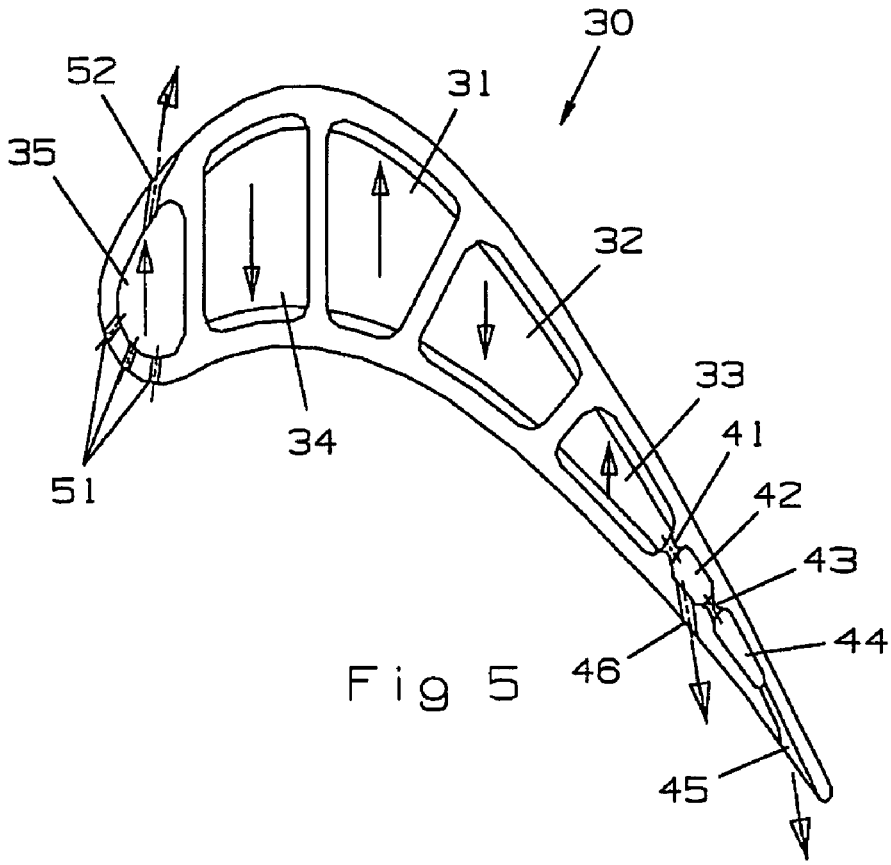
FIG. 5 shows a cross section top view of the cooling circuit of the present invention.
Figure 6:
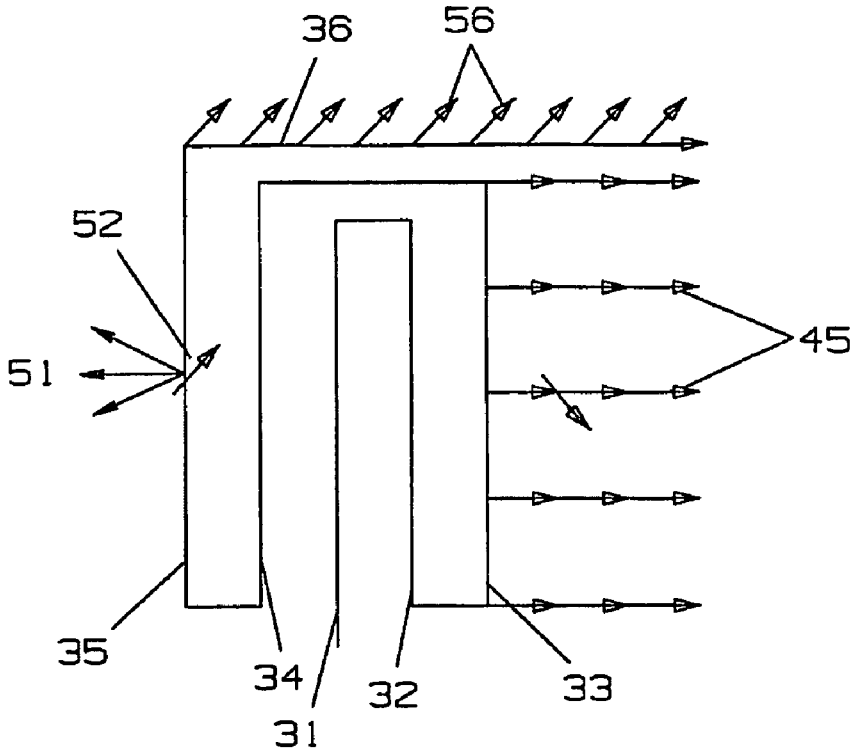
FIG. 6 shows a flow diagram of the cooling circuit of the present invention.
Figure 7:
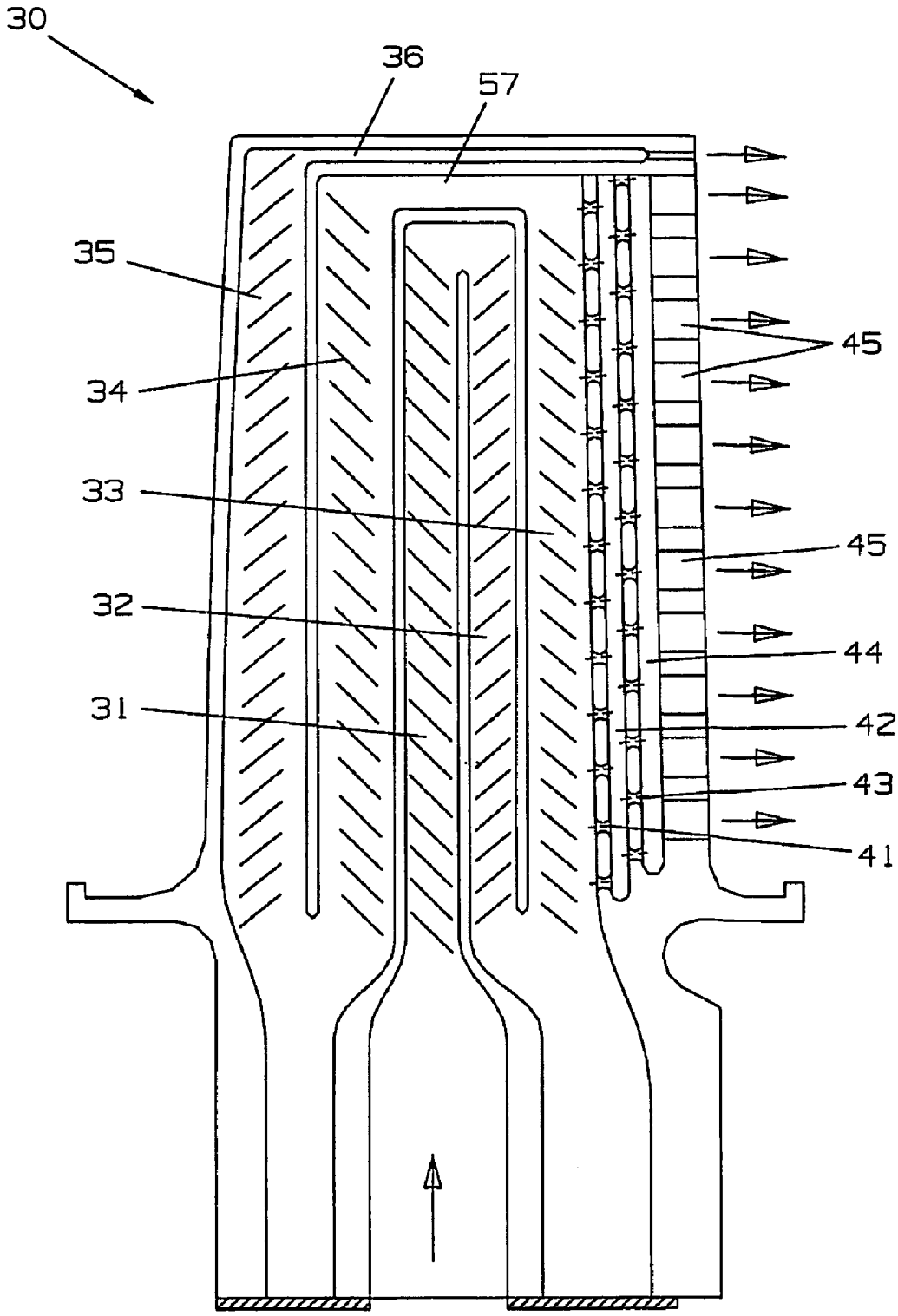
FIG. 7 shows a cross section side view of the turbine rotor blade cooling circuit of the present invention.

The 6-pass serpentine flow cooling circuit of the present invention is intended for use in a turbine rotor blade of an IGT, but could also be used in an aero engine rotor blade. FIG. 5 shows a turbine rotor blade 30 with the 6-pass serpentine flow cooling circuit of the present invention which includes a first leg or channel 31 that supplies the pressurized cooling air from an external source to the blade cooling circuit, a second leg 32 located aft of the first leg 31, a third leg 33 located adjacent to a trailing edge region of the blade airfoil, a fourth leg 34 located forward of the first leg 31, a fifth leg 35 located adjacent to the leading edge of the airfoil, and a sixth leg 36 (see FIG. 6) located under the tip cap and extending along a chordwise direction of the blade. The legs 31-25 form cooling air channels from the platform region to the tip region that extend from the pressure side wall to the suction side wall and include chevron trip strips to promote heat transfer from the walls to the cooling air. A cross-over channel 57 connects the third leg 33 to the fourth leg 34 as seen in FIG. 7 and provides additional cooling for the tip region of the blade airfoil.

The trailing edge region of the airfoil is cooled by a series of impingement holes 41 and 43 and impingement channels 42 and 44 that are connected to the first leg 31 of the serpentine circuit and bleed off cooling air from the first leg 31. A row of exit slots or holes 45 are positioned along the pressure side wall and discharge the cooling air from the trailing edge impingement cooling circuit. The first impingement cavity or channel 42 is connected to a row of film cooling holes 46 on the pressure side wall to discharge a layer of film cooling air.

The airfoil leading edge is cooled by bleeding off cooling air from the fifth leg 35 and discharging the cooling air through a showerhead arrangement of film cooling holes 51 and even gill holes 52 located on the suction side wall and even on the pressure side wall is required. The sixth leg 36 of the serpentine connects to the end of the fifth leg 35 and provides cooling for the blade tip along with discharging cooling air through tip cooling holes 56. A tip cooling channel exit hole discharges the cooling air from the sixth leg 36 out through the trailing edge of the airfoil.

Pressurized cooling air is supplied from an external source, such as the compressor of the gas turbine engine, and into the root cooling air passage that opens into the first leg 31 of the serpentine flow circuit formed within the blade. The cooling air flows up toward the blade tip in the first leg 31, makes a U-turn near the tip region and into the second leg 32, and then flows into the third leg 33 toward the tip region. from the third leg 33, some of the cooling air is bled off through the row of first impingement cooling holes 41 formed within a first spanwise extending rib in the trailing edge region and into a first impingement cavity 42. A second row of impingement holes 43 and second impingement cavity 44 is located downstream in the trailing edge region to provide cooling for this region. a row of exit slots 45 and a row of film cooling holes 46 on the pressure side wall discharges the cooling air from the trailing edge region cooling circuit.

Cooling air from the third leg 33 that does not flow into the trailing edge region makes a turn in the cross-over channel 57 and flows into the fourth leg 34 downward toward the platform, and then turns upward into the fifth leg 35 to flow along the leading edge of the blade airfoil. Most of the cooling air in the fifth leg 35 bleeds off through a showerhead arrangement of film cooling holes 51 and one or more rows of gill holes 52 to provide film cooling for the leading edge surface of the airfoil. The remaining cooling air in the fifth leg 35 flows up and into the sixth leg 36 which is located underneath the tip cap to provide cooling here. A number of tip cooling holes 56 discharges cooling air to cool the tip and an exit hole discharges the remaining cooling air to provide cooling for the trailing edge tip corner.

Figure 1:
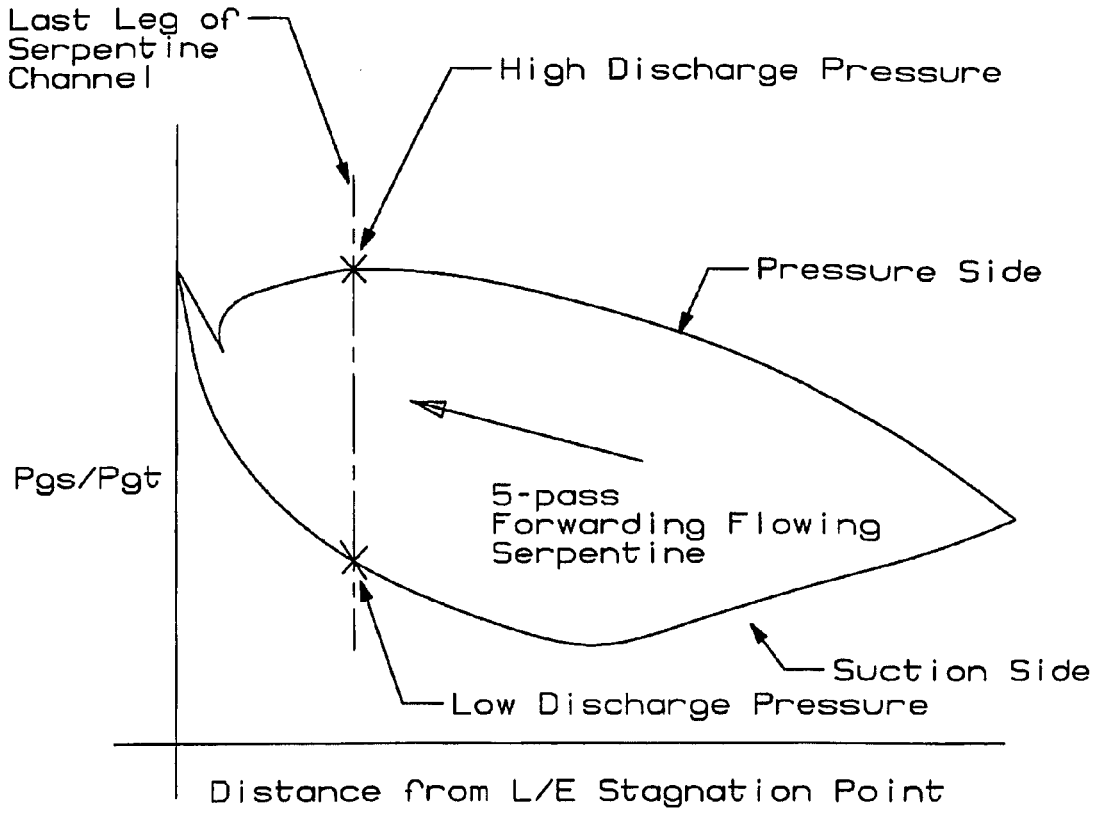
Fig 1 Prior Art
FIG. 1 shows a graph of a turbine rotor blade external pressure profile.
Figure 2:
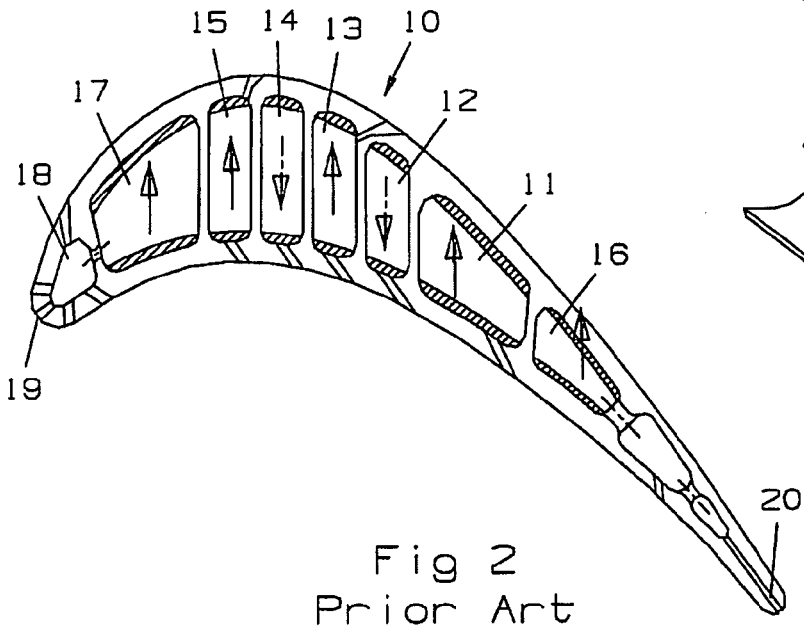
Fig 2 Prior Art
FIG. 2 shows a cross section top view of a prior art turbine rotor blade 1+5+1 forward flowing serpentine cooling circuit.
Figure 3:
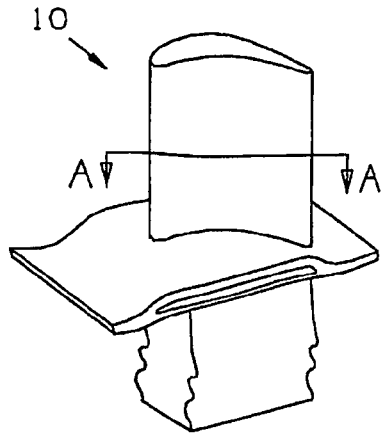
Fig 3 Prior Art
FIG. 3 shows a schematic view of the prior art turbine rotor blade.
Figure 4:
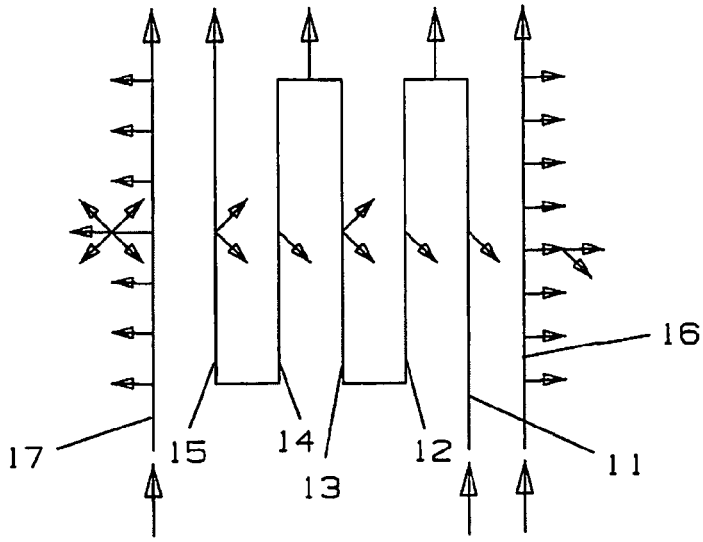
Fig 4 Prior Art
FIG. 4 shows a flow diagram of the prior art 1+5+1 serpentine flow cooling circuit of FIG. 2.

The 6-pass serpentine cooling air is fed through the blade leading edge section. This particular use of the 6-pass cooling air is totally different from the prior art FIG. 2 serpentine flow circuit. The prior art 5-pass serpentine cooling is fed through the blade aft section and then flows forward for the forward flowing serpentine design. Also, in another 5-pass serpentine circuit of the prior art, the circuit flows in an aft direction from the leading edge region toward the trailing edge region. The 6-pass serpentine flow circuit of the present invention is fed through the blade mid-chord section. Since the cooling air temperature is fresh (the lowest available for blade cooling) and the blade mid-chord section contains more metal than both ends of the airfoil, a maximum use of the cooling air potential to produce a low mass average temperature is achieved which yields a higher stress rupture life for the blade.

The first portion of the 6-pass serpentine flow cooling circuit includes a triple pass aft flowing serpentine flow circuit that provides cooling for the aft section of the airfoil. A portion of the cooling air is discharged from the airfoil at the third leg of the serpentine flow circuit for the cooling of the airfoil trailing edge. The aft flowing serpentine flow circuit is used for cooling the airfoil aft section will maximize the use of cooling air pressure potential. Since the cooling air is discharged on the airfoil trailing edge region where the main stream hot gas side pressure is rather low, the aft flowing triple pass circuit will consume less pressure than the forward flowing 5-pass serpentine circuit of the prior art. This results in a low cooling supply pressure required for the 6-pass serpentine flow circuit of the present invention.

At the end of the forward flowing triple pass serpentine cooling channel another triple pass forward flowing serpentine is followed to provide the cooling for the forward portion of the blade leading edge section. The forward flowing serpentine cooling flow circuit used for the airfoil leading edge section surface will maximize the use of blade tip cooling air potential. The spent cooling air is then channeled through the blade tip section axial flow channel to provide for the blade tip section cooling and the spent cooling air is finally discharged at the aft section of the airfoil along the pressure side peripheral as film cooling air for the blade tip edge corner. The gas side pressure is low and thus yields a high cooling air to main stream pressure potential to be used for the serpentine channels which will maximize the internal cooling performance for the serpentine. In addition, the design of the present invention yields a lower cooling supply pressure requirement and a lower leakage flow.

Major design features and advantages of the cooling circuit of the present invention over the cited prior art cooling circuit are described below. The 6-pass serpentine flow cooling circuit of the present invention cooling circuit will minimize the blade BFM issue. The blade total cooling air is fed through the airfoil mid-chord section and flows toward the trailing edge to maximize the use of cooling air pressure potential. A higher cooling mass flow through the airfoil main body will yield lower mass average blade metal temperature which results in a higher stress rupture life for the blade.

Also, the tip section cooling air is used for the cooling of the entire airfoil first. This doubles the use of the cooling air and will maximize the blade cooling effectiveness. In addition, combining the tip section cooling air into the airfoil main body serpentine will enhance the serpentine convective effectiveness as well as eliminate the low Mach number issue at the end of the serpentine flow channel.

Also, all the heat transfer in the serpentine turns for the 6-pass chordwise tip serpentine occurs along the blade pressure and suction peripheral which will enhance the blade tip section convective cooling. In addition, the tip turns for the airfoil main body will also provide additional tip section cooling. As a result of this cooling design, double cooling for the blade tip section yields a better cooling of the blade tip. Film cooling may also be used at the aft portion of the tip 6-pass chordwise flow circuit.

Also, the aft then forward flowing 6-pass serpentine flow cooling circuit maximizes the use of cooling air to provide for a very high overall cooling efficiency for the entire airfoil. The aft flowing serpentine cooling flow circuit used for the airfoil main body will maximize the use of cooling to the main stream gas side pressure potential. A portion of the air is discharged at the aft section of the airfoil where the gas side pressure is low and thus yields a high cooling air to main stream pressure potential to be used for the serpentine channels and maximize the internal cooling performance for the serpentine circuit. The aft flowing dual 6-pass serpentine flow channel yields a lower cooling supply pressure requirement and a lower leakage.

I claim the following:

1. An air cooled turbine rotor blade comprising:

an airfoil having an airfoil cross sectional shape with a leading edge and a trailing edge, and a pressure side wall and a suction side wall both extending between the two edges;

an aft flowing serpentine flow cooling circuit formed within the airfoil and having a first leg located in an airfoil mid-chord region;

a forward flowing serpentine flow cooling circuit connected in series with the aft flowing serpentine flow cooling circuit;

the forward flowing serpentine flow cooling circuit being located forward of the aft flowing serpentine flow cooling circuit; and, a cross-over channel to connect the aft flowing serpentine flow cooling circuit to the forward flowing serpentine flow cooling circuit, the cross-over channel providing cooling for a tip region of the blade.

2. The air cooled turbine rotor blade of claim 1, and further comprising:

the aft flowing serpentine flow cooling circuit and the forward flowing serpentine flow cooling circuit both extend along the blade spanwise direction from the platform region to the blade tip region of the airfoil.

3. The air cooled turbine rotor blade of claim 1, and further comprising:

the last leg of the forward flowing serpentine flow cooling circuit extending in the airfoil spanwise direction is located adjacent to the leading edge of the airfoil; and, a showerhead arrangement of film cooling holes connected to the last leg.

4. The air cooled turbine rotor blade of claim 3, and further comprising:

the last leg of the forward flowing serpentine flow cooling circuit is connected to a blade tip cooling channel that extends from the leading edge to the trailing edge of the blade tip.

5. The air cooled turbine rotor blade of claim 4, and further comprising:

the blade tip cooling channel forms a sixth leg of a 6-pass serpentine flow cooling circuit.

6. The air cooled turbine rotor blade of claim 4, and further comprising:

the blade tip cooling channel is connected to a plurality of tip cooling holes.

7. The air cooled turbine rotor blade of claim 1, and further comprising:

the aft flowing serpentine flow cooling circuit and the forward flowing serpentine flow cooling circuit and a blade tip cooling channel that extends from the leading edge region to the trailing edge region of the blade tip forms a 6-pass serpentine flow cooling circuit with the blade tip cooling channel forming the sixth leg of the serpentine circuit.

8. The air cooled turbine rotor blade of claim 7, and further comprising:

the first leg of the 6-pass serpentine flow cooling circuit is located aft of and adjacent to the fourth leg of the 6-pass serpentine flow cooling circuit.

9. The air cooled turbine rotor blade of claim 7, and further comprising:

the first leg and the second leg and the third leg and the fourth leg are each formed without film cooling holes that discharge cooling air from the leg.

10. The air cooled turbine rotor blade of claim 1, and further comprising:

the channels in the all flowing serpentine flow cooling circuit and the forward flowing serpentine flow cooling circuit all extend across from the pressure side wall to the suction side wall of the airfoil.

11. The air cooled turbine rotor blade of claim 1, and further comprising:

the last leg of the aft flowing serpentine flow cooling circuit is connected to a series of impingement cooling holes formed within the trailing edge region of the airfoil; and, a row of exit slots connected to the series of impingement cooling holes to discharge spent cooling air from the airfoil.

12. A process for cooling a turbine rotor blade used in a gas turbine engine, the rotor blade including a leading edge with a showerhead arrangement of film cooling holes and a trailing edge with a row of exit slots to discharge cooling air, the process comprising:

supplying pressurized cooling air to the rotor blade;

passing the cooling air through a serpentine flow path towards the trailing edge region of the blade;

bleeding off a portion of the cooling air through a series of impingement holes to provide cooling for the trailing edge region of the blade;

passing the remaining cooling air through a forward flowing serpentine path towards the leading edge of the blade;

bleeding off a portion of the cooling air through the showerhead film cooling holes to provide film cooling to the leading edge of the blade; and, passing the remaining cooling air underneath the blade tip to provide cooling for the blade tip.

13. The process for cooling a turbine rotor blade of claim 12, and further comprising the step of:

cooling the blade tip by discharging most of the remaining cooling air through tip holes.

14. The process for cooling a turbine rotor blade of claim 12, and further comprising the step of:

not discharging film cooling air from the serpentine flow channels except for the leading edge channel connected to the showerhead film holes so that a low cooling flow will be produced for the blade.

* * * * *